US006376987B1

(12) United States Patent
Amemiya et al.

(10) Patent No.: US 6,376,987 B1
(45) Date of Patent: Apr. 23, 2002

(54) AC-DRIVING PLASMA DISPLAY PANEL OF SURFACE-DISCHARGE TYPE

(75) Inventors: Kimio Amemiya; Mitsunori Nozu, both of Yamanashi (JP)

(73) Assignee: Pioneer Electronics Corporation, Tokyo (JP)

( * ) Notice: Subject to any disclaimer, the term of this patent is extended or adjusted under 35 U.S.C. 154(b) by 0 days.

(21) Appl. No.: 09/290,199

(22) Filed: Apr. 13, 1999

(30) Foreign Application Priority Data

Apr. 14, 1998 (JP) ..... 10-119987

(51) Int. Cl.[7] ..... H01J 17/49
(52) U.S. Cl. ..... 313/586; 313/582; 313/587
(58) Field of Search ..... 313/582, 584, 313/586, 587, 583, 585

(56) References Cited

U.S. PATENT DOCUMENTS 5,548,186 A * 8/1996 Ota ..... 313/583
5,661,500 A * 8/1997 Shinoda et al. ..... 313/585
5,952,782 A * 9/1999 Nanto et al. ..... 313/582
6,236,160 B1 * 5/2001 Komaki et al. ..... 313/586

* cited by examiner

*Primary Examiner*—Michael H. Day
*Assistant Examiner*—Joseph Williams
(74) *Attorney, Agent, or Firm*—Sughrue Mion, PLLC

(57) ABSTRACT

A plasma display panel has, on the display-side inner surface of one substrate out of a pair of substrates disposed opposite to each other via a discharge space, plural pairs of row electrodes extending in parallel in a first direction with each discharge gap held therebetween, dielectric layers for the row electrodes with respect to the discharge space; and on the back-side inner surface of the other substrate disposed opposite to the display-side substrate, plural pairs of column electrodes extending in a second direction perpendicularly crossing the first direction and forming unit luminous areas in intersecting portions with respect to the respective pairs of row electrodes, and belt-like partition walls for partitioning the discharge space into the unit luminous areas in the first direction. The row electrode includes a transparent conductive film having a body portion extending in the first direction in the proximity of the discharge gap and a projecting portion projecting in each unit luminous area from the body portion in a direction away from the discharge gap, and a metal film connected to the leading end portion of the projecting portion of the transparent conductive film and extending in the first direction.

6 Claims, 4 Drawing Sheets

AC-DRIVING PLASMA DISPLAY PANEL OF SURFACE-DISCHARGE TYPE

BACKGROUND OF THE INVENTION

1. Field of the Invention

This invention relates to an AC-driving plasma display panel (PDP) of a surface-discharge type.

2. Description of the Related Art

There is growing anticipation of making fit for practical use an AC-driving PDP of a surface-discharge type as a large-scaled and thin color display unit. FIG. 4 shows a structural example of such an AC-driving PDP of the surface-discharge type. As shown in FIG. 4, plural pairs of row electrodes 12 are formed on a front glass substrate 11 constituting a display surface side so that the pairs of row electrodes 12 are set in parallel to each other and the row electrodes 12 making the pair are coated with a dielectric layer 13, which is coated with a protective layer 14 of MgO. The row electrode 12 includes a transparent electrode 12*a* formed of a transparent conductive film such as an ITO film or the like and a metal auxiliary electrode (a bus electrode) 12*b* formed of a metal film for supplementing the conductivity of the transparent electrode 12*a*.

On the other hand, a plurality of column electrodes 16 are disposed in parallel to each other at given intervals on the inner surface side of a back glass substrate 15 as the back side and a phosphor layer 17 for coating each of the row electrodes 16 is also formed thereon. The front glass substrate 11 and the back glass substrate 15 are disposed separately to form closed discharge spaces 18.

Moreover, there are formed partition walls (ribs) 19 having a predetermined height and used for forming the discharge space 18 between the column electrodes 16 in each unit luminous area 22. A discharge cell is formed at each of the intersections between the pair of row electrodes 12 and the column electrode 16. Rare gas is enclosed in the discharge spaces 18.

The dielectric layer 13 is formed by applying low-melting glass paste containing, for example, lead oxide (Pbo) onto the plurality of pairs of row electrodes 12 and calcining the row electrodes 12. Furthermore, Al (aluminum), Al alloy, Ag (silver), Ag alloy or the like is used to form the metal film because the metal film is required to have low resistance in order to supplement the conductivity of the transparent conductive film.

FIG. 5 is a partial enlarged view of the pair of row electrodes as seen from the display surface side of PDP. As aforementioned, the pair of row electrodes 12 made up of the pair of transparent electrodes 12*a* and the pair of bus electrodes 12*b* which are stacked on and connected to the respective pair of the transparent electrodes 12*a*. The pair of transparent electrodes 12*a* in each unit luminous area (discharge cell) 22 have a plurality of opposing projecting portions 20 via a discharge gap 21.

The use of the transparent electrodes provided with the projecting portions as stated above allows decreasing the area of the electrode and suppressing a discharge current value. However, the front glass substrate must be precisely registered with the back glass substrate when the PDP is made in order that the discharge characteristic of each discharge cell is uniformized because the discharge characteristic of the discharge cell is adversely affected by the distance between the leading end portions of the projecting portions near the discharge gap and the partition walls. Since the registration needs accuracy in proportion as the discharge cell is reduced in size, moreover, it has been difficult to employ a transparent electrode having such a projecting portion for an extremely small discharge cell.

SUMMARY OF THE INVENTION

An object of the present invention intended to solve the foregoing problems is to provide a plasma display panel capable of demonstrating improved reliability and fine alignment.

To achieve the above object, according to a first aspect of the invention, there is provided a plasma display panel comprising:

first and second substrates disposed opposite to each other via a discharge space, said first substrate being disposed at a display side;

plural pairs of row electrodes formed on an inner surface of said first substrate and extending in parallel in a first direction with each discharge gap held therebetween;

a dielectric layer coated on said row electrodes and partially defining said discharge space;

plural pairs of column electrodes formed on an inner surface of said second substrate and extending in a second direction perpendicularly crossing the first direction and forming unit luminous areas in intersecting portions with respect to the respective pairs of first row electrodes; and belt-like partition walls for partitioning said discharge space into said unit luminous areas in said first direction;

wherein each of said row electrodes comprises: a transparent conductive film having a body portion extending in said first direction in the proximity of said discharge gap and a projecting portion projecting in each unit luminous area from said body portion in a direction away from said discharge gap, and a metal film connected to a leading end portion of the projecting portion of said transparent conductive film and extending in said first direction.

A second aspect of the invention has been achieved by the provision of the plasma display panel according to the first aspect of the invention, wherein the surface of the dielectric layer in a portion existing on the metal film and facing the partition walls is projected toward a portion in the proximity of the discharge gap.

A third aspect of the invention is achieved by the provision of the plasma display panel according to the second aspect of the invention, wherein the surface of the dielectric layer between the adjoining metal films of the adjoining metal film of the adjoining unit luminous areas in the second direction is projected toward a portion in the proximity of the discharge gap.

In the plasma display panel according to the present invention, as the row electrode includes the transparent conductive film having the body portion extending in the first direction in the proximity of the discharge gap and the projecting portion projecting in each unit luminous area from the body portion in a direction away from the discharge gap, and the metal film connected to the leading end portion of the projecting portion of the transparent conductive film and extending in the first direction, the influence of the discharge characteristic resulting from the shifting of the relative position of the transparent conductive film to the partition wall is made reducible, whereby the registration accuracy of the front glass substrate with respect to the back glass substrate can be lessened.

In the plasma display panel according to the present invention, moreover, as the surface of the dielectric layer between the adjoining metal films adjacent to the unit luminous area in the second direction of the metal film is projected toward the portion in the proximity of the discharge gap, whereby an error discharge between the adjoining discharge cells is suppressed.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

The preferred embodiment of the invention will now be described with reference to the drawings.

Figure 1:
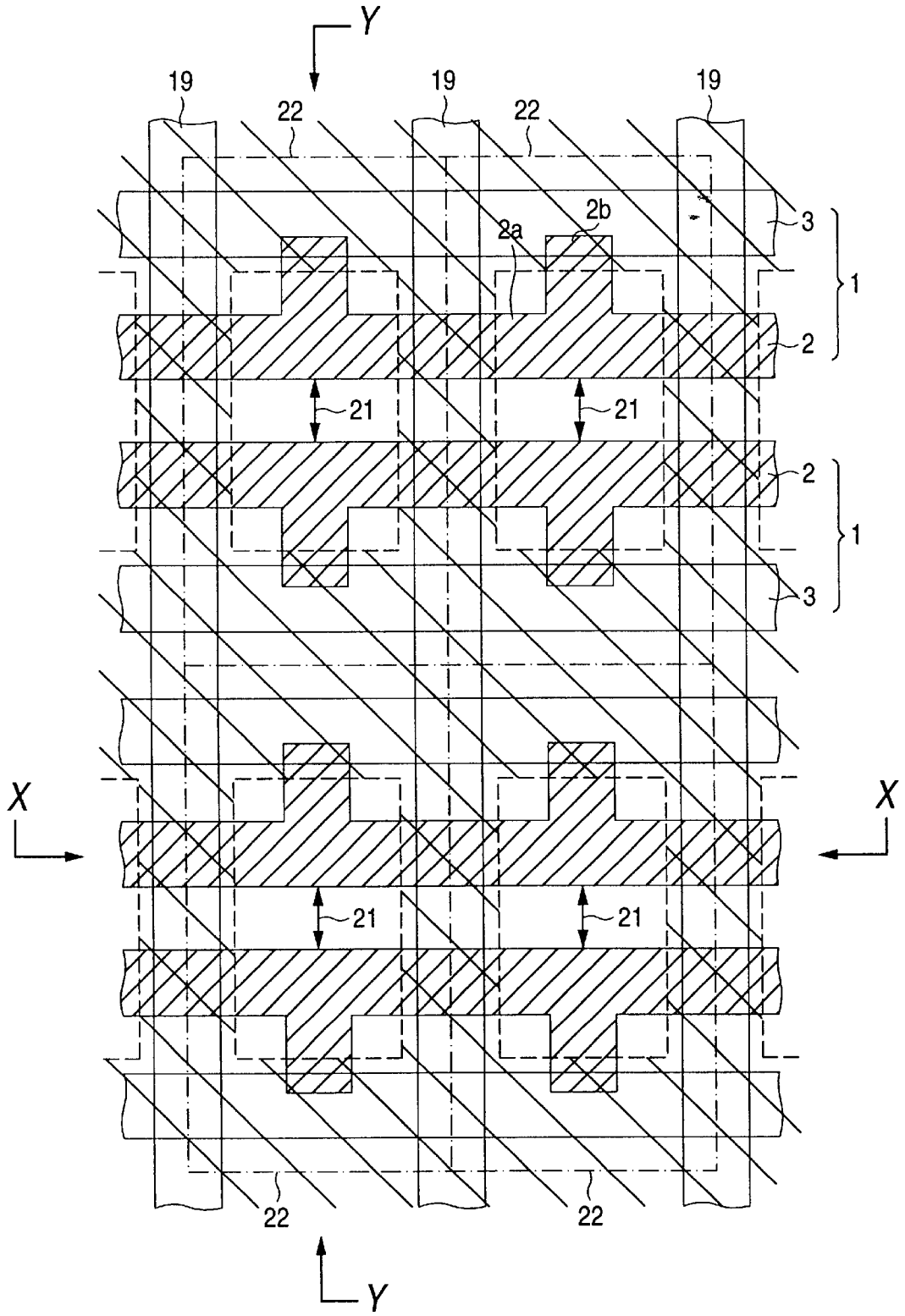
FIG. 1 is a schematic structural drawing (plan view) of the principal part of a PDP embodying the invention.
Figure 2:
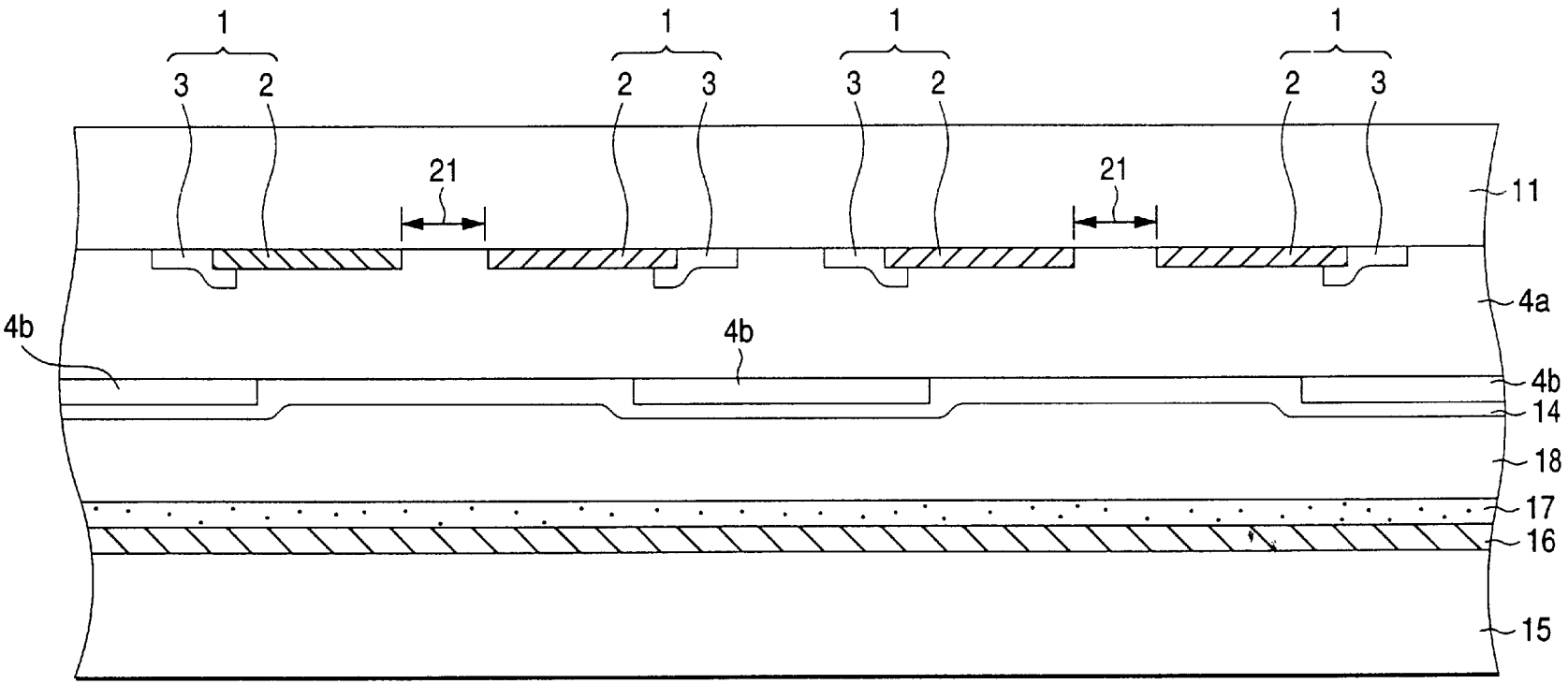
FIG. 2 is a schematic structural drawing (sectional view) of the principal part of the PDP according to the embodiment of the invention.
Figure 3:
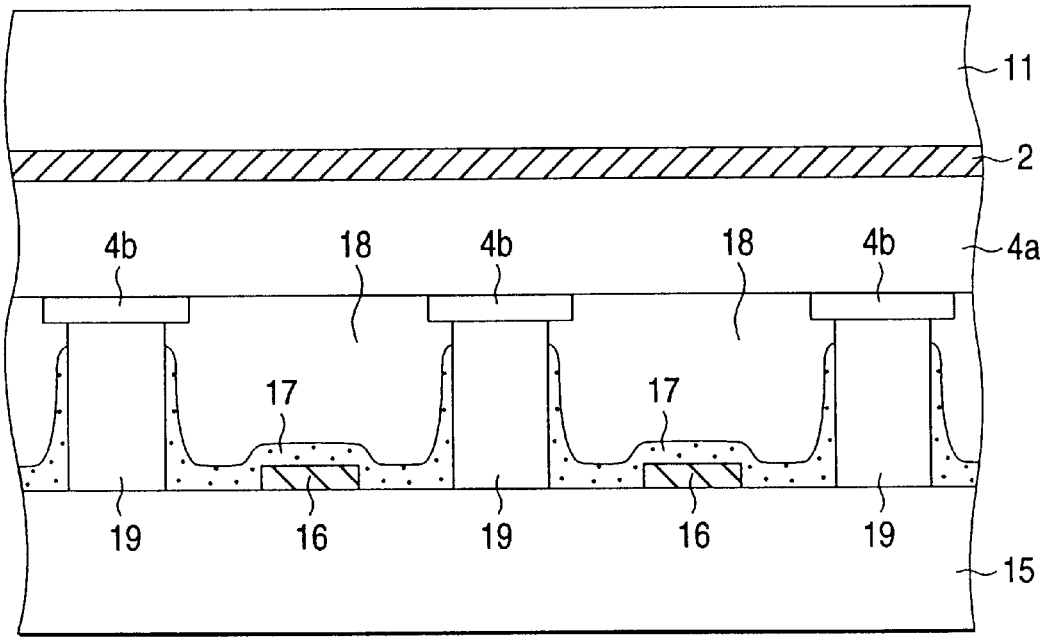
FIG. 3 is a schematic structural drawing (sectional view) of the principal part of the PDP according to the embodiment of the invention.
Figure 4:
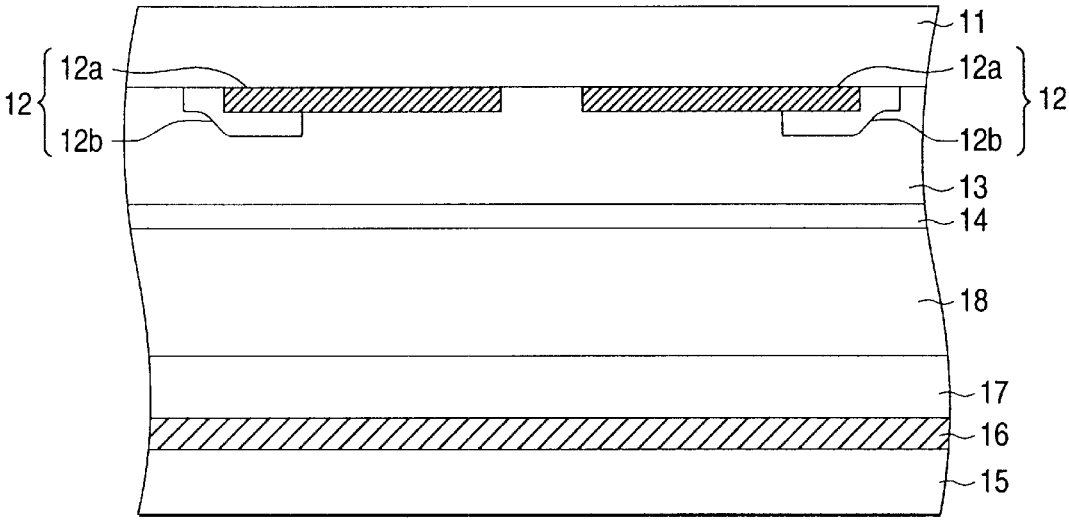
FIG. 4 is a diagram illustrating an example of the structure of an AC-driving PDP of a surface-discharge type.

FIGS. 1 to 3 refer to a schematic structural drawing of the principal part of an AC-driving PDP of a surface-discharge type embodying the present invention, wherein FIG. 1 is a plan view; FIG. 2, a sectional view taken along a Y—Y direction (a second direction) in FIG. 1; and FIG. 3, a sectional view taken along an X—X direction (a first direction) in FIG. 1.

As shown in FIGS. 1 to 3, the PDP includes, beneath a front glass substrate 11 as a display surface side, plural pairs of row electrodes 1 so arranged as to extend in parallel to each other in a first direction (i.e., along an X—X direction in FIG. 1), a dielectric layer 4 which is a low-melting glass layer having a low dielectric constant and alkaline glass as its main ingredient for coating the plural pairs of row electrodes 1, and a protective layer 14 of MgO for coating the dielectric layer 4.

The row electrode 1 includes a transparent electrode 2 formed of a transparent conductive film such as an ITO film or the like and a metal auxiliary electrode (a bus electrode) 3 formed of a metal film for supplementing the conductivity of the transparent electrode 2. The pair of row electrodes 1 form a discharge gap 21 in each unit luminous area (a discharge cell) 22.

On the inner surface side of a back glass substrate 15 on the back side disposed opposite to the front glass substrate 11, on the other hand, there are provided a plurality of column electrodes 16 so that the column electrodes 16 are extended in parallel to each other in a second direction (i.e., along a Y—Y direction in FIG. 2) perpendicularly crossing the first direction, phosphor layers 17 for coating the respective column electrodes 16, and belt-like partition walls (ribs) 19 having a predetermined height and used for forming each discharge space 18 between the column electrodes 16.

The front glass substrate 11 and the back glass substrate 15 are disposed separately from each other via the discharge spaces 18 and rare gas is enclosed in the discharge spaces 18. A unit luminous area (a discharge cell) 22 is formed at each intersection between the pair of row electrode 1 and 1 and the column electrode 16.

In this embodiment, the transparent electrode 2 is formed of a transparent conductive film including a body portion 2*a* extending in the first direction near each discharge gap 21 and a projecting portion 2*b* projecting from the body portion 2*a* in each discharge cell 22 in a direction away from the discharge gap 21.

The bus electrode 3 is formed of a metal film connected to the leading end portion of each projecting portion 2*b* of the transparent electrode 2 and extending in the first direction. Furthermore, Al (aluminum), Al alloy, Ag (silver), Ag alloy or the like is used to form the metal film because the metal film is required to have low resistance in order to supplement the conductivity of the transparent conductive film.

Figure 5:
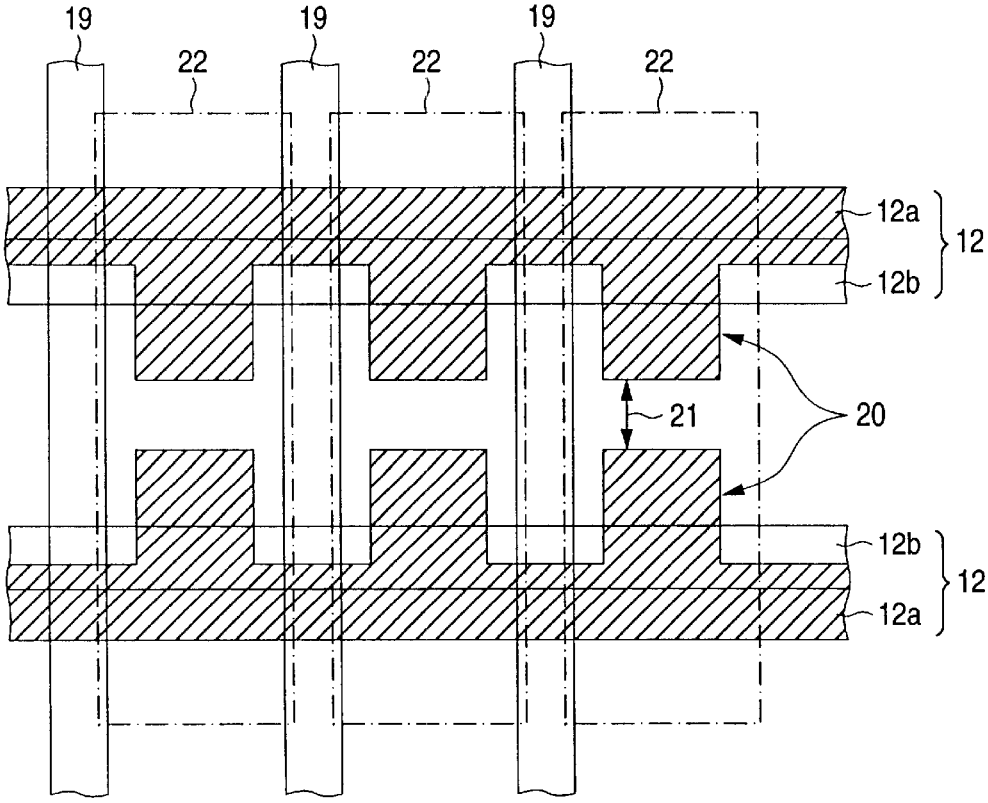
FIG. 5 is a partial enlarged view of a pair of row electrodes as seen from the display side of the PDP.

Consequently, the contact area between the transparent electrode 2 and the bus electrode 3 can be made smaller than the contact area between the transparent electrode 12*a* and the bus electrode 12*b* of the prior art row electrode 12 shown in FIG. 5. When the alkaline glass whose ion conductivity is increased at the time of calcining the dielectric layer 4 is brought into contact with the transparent electrode with the use of Al (aluminum) or Al alloy as the bus electrode 3, the transparent electrode, the alkaline glass and the bus electrode form a local battery system and cause the transparent electrode to corrode and discolor. However, the discoloration of the transparent electrode can be prevented much more than before with the effect of improving PDP reliability. In the case of employing Ag (silver) or Ag alloy as the bus electrode 3, moreover, there develops a problem arising from the adhesion of Ag to ITO (the transparent electrode) though the problem of discoloration of the transparent electrode becomes solvable. Nevertheless, since the contact area between the transparent electrode 2 and the bus electrode 3 has been reduced according to the present invention, the probability of causing the peeling of the, electrodes decreases, which also results in improving PDP reliability.

As the discharge gap 21 of each discharge cell 22 is formed between the body portions 2*a* extending in the first direction of the transparent electrode 2, no discharge characteristic fluctuation occurs even though the position of the transparent electrode 2 is relatively shifted from that of the partition wall 19, nor does discharge characteristic variation between the adjoining discharge cells 22. Consequently, the registration accuracy of the front glass substrate with respect to the back glass substrate can be lessened when the PDP is made.

In FIG. 1, a portion which has oblique lines and is surrounded with a broken line indicates the projecting portion formed by projecting the surface of the dielectric layer 4 toward the proximity of a discharge gap 6, that is, by projecting the surface thereof existing on the bus electrode (metal film) 3 and between the adjoining bus electrodes (metal films) 3 of the adjoining discharge cells 22 in the second direction and facing the partition walls 19.

As shown in FIGS. 2 and 3, the dielectric layer 4 includes a first dielectric layer 4*a* so formed as to uniformly cover the front glass substrate 11 and the row electrodes 1, and second dielectric layers (raised dielectric layers) 4*b* formed on the bus electrodes (metal films) 3 on the surface of the first dielectric layer 4*a* and in areas each existing between the adjoining bus electrodes (metal films) 3 of the adjoining discharge cells 22 in the second direction and facing the partition walls 19.

Due to each second dielectric layer 4*b* existing on the bus electrode (metal film) 3 and between the adjoining bus electrodes (metal films) 3 of the adjoining discharge cells 22 in the second direction, the discharge is restrained from expanding and an error discharge is also prevented to occur between the adjoining discharge cells 22 in the second direction. Moreover, due to the second dielectric layer (raised dielectric layer) 4*b* formed in the area facing the partition walls 19, the gap between the partition wall 19 and the dielectric layer 4 is eliminated, so that an error discharge between the adjoining discharge cells 22 in the first direction is also prevented.

In the plasma display panel according to the present invention, as the row electrode includes the transparent conductive film having the body portion extending in the first direction in the proximity of the discharge gap and the projecting portion projecting in each unit luminous area from the body portion in a direction away from the discharge gap, and the metal film connected to the leading end portion of the projecting portion of the transparent conductive film and extending in the first direction, the influence of the discharge characteristic resulting from the shifting of the relative position of the transparent conductive film to the partition wall is made reducible, whereby the registration accuracy of the front glass substrate with respect to the back glass substrate can be lessened. With this arrangement, it is consequently possible to not only improve the reliability of the plasma display panel but increase fine alignment.

In the plasma display panel according to the present invention, moreover, as the surface of the dielectric layer between the adjoining metal films adjacent to the unit luminous area in the second direction of the metal film is projected toward the portion in the proximity of the discharge gap, whereby an error discharge between the adjoining discharge cells is suppressed with the effect of improving the display level.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A display panel comprising:

a pair of row electrodes extending in parallel in a first direction;

a discharge gap formed between said pair of row electrodes;

a column electrode extending in a second direction, wherein said second direction is different than said first direction;

wherein a unit luminous area is defined by a region in which said column electrode crosses said pair of row electrodes, and wherein each of said row electrodes comprises:

a first conductive layer having a body portion and a projecting portion, wherein said body portion extends in said first direction, wherein said projecting portion comprises an end portion, and wherein said projecting portion extends from said body portion away from said discharge gap towards said end portion.

2. The display panel as claimed in claim 1, wherein each of said row electrodes further comprises:

a second conductive layer that is connected to and overlaps said end portion of said projecting portion.

3. The display panel as claimed in claim 2, wherein said first conductive layer comprises a transparent conductive layer and said second conductive layer comprises a metal layer.

4. The display panel as claimed in claim 1, wherein said first conductive layer is a transparent conductive layer.

5. The display panel as claimed in claim 1, further comprising:

partition walls, wherein said column electrode is disposed between said partition walls, wherein a discharge space is disposed between said pair of row electrodes and said column electrode, and wherein said partition walls partition said discharge space into said unit luminous area.

6. The display panel as claimed in claim 5, wherein said partition walls are substantially parallel to said column electrode.

* * * * *